US006997233B2

(12) United States Patent
Osanai et al.

(10) Patent No.: US 6,997,233 B2
(45) Date of Patent: Feb. 14, 2006

(54) MOLD AND METHOD FOR MANUFACTURING METAL-CERAMIC COMPOSITE MEMBER

(75) Inventors: Hideyo Osanai, Tokyo (JP); Susumu Ibaragi, Tokyo (JP); Makoto Namioka, Tokyo (JP)

(73) Assignee: Dowa Mining Co., Ltd., Tokyo (JP)

( * ) Notice: Subject to any disclaimer, the term of this patent is extended or adjusted under 35 U.S.C. 154(b) by 20 days.

(21) Appl. No.: 10/668,342

(22) Filed: Sep. 24, 2003

(65) Prior Publication Data

US 2005/0016707 A1 Jan. 27, 2005

(30) Foreign Application Priority Data

Sep. 30, 2002 (JP) ..... 2002-287086

(51) Int. Cl.
*B22D 19/00* (2006.01)
*B22D 19/02* (2006.01)
*B22D 19/04* (2006.01)
*B22D 10/08* (2006.01)

(52) U.S. Cl. ..... 164/112; 164/332

(58) Field of Classification Search ..... 164/112, 164/332–334; 264/46.4–46.9
See application file for complete search history.

(56) References Cited

U.S. PATENT DOCUMENTS 3,718,172 A 2/1973 Rice et al.
5,570,502 A * 11/1996 Sawtell et al. ..... 29/527.6
6,183,875 B1 2/2001 Ning et al.
6,848,496 B1 * 2/2005 Ban et al. ..... 164/359

FOREIGN PATENT DOCUMENTS

| | | | |
|---|---|---|---|
| DE | 3724995 A1 | | 9/1988 |
| EP | 1 187 198 A | | 3/2002 |
| JP | A-55-149178 | | 11/1980 |
| JP | A-60-216968 | | 10/1985 |
| JP | A-61-115662 | | 6/1986 |
| JP | A-08-215828 | | 8/1996 |
| JP | 8-300137 | * | 11/1996 |
| JP | A-11-226717 | | 8/1999 |
| JP | 11-342461 | * | 12/1999 |

* cited by examiner

*Primary Examiner*—Kuang Y. Lin
(74) *Attorney, Agent, or Firm*—Oliff & Berridge, PLC

(57) ABSTRACT

To provide a mold capable of manufacturing a metal-ceramic composite member in which a predetermined number of ceramic members are joined onto a large joining metal, the large joining metal being free from swell and shrinkage cavity on the surface thereof and high in dimensional precision. A metal-ceramic composite member 3 according to this embodiment is manufactured in such a manner that a predetermined number of metal-ceramic bonded substrates 30 are placed in a mold main body 11 constituting a mold 1, with a ceramic substrate 31 side thereof facing upward, an atmosphere inside and outside the mold 1 is replaced with an inert gas such as a nitrogen gas from the atmosphere, a molten metal 42 is poured and filled in a first joining portion 14 that is formed by the molten metal main body 11 and an upper container 13 and that has a shrinkage cavity inducing portion 16 on a metal material holding portion side and a shrinkage cavity inducing portion 18 on an air vent side, and the molten metal 42 is cooled.

12 Claims, 3 Drawing Sheets

30
32
33
31

32
31

33
32
31

34
33
32
31

MOLD AND METHOD FOR MANUFACTURING METAL-CERAMIC COMPOSITE MEMBER

BACKGROUND OF THE INVENTION

1. Field of the Invention

The present invention relates to a mold for manufacturing a metal-ceramic composite member in which a ceramic and a metal are firmly joined together by a direct joining strength on an interface therebetween.

2. Description of the Related Art

Metal-ceramic composite members taking advantages of characteristics of ceramic such as chemical stability, high melting point, insulation performance, high hardness, and relatively high heat conductivity and characteristics of metal such as high strength, high toughness, easy workability, and electrical conductivity are in wide use for automobiles, electronic equipment, and so on, and typical examples thereof are metal-ceramic composite substrates and packages for automobile turbocharger rotors and for mounting high-power electronic elements.

As methods for manufacturing the metal-ceramic composite members, adhesive bonding, plating, metallization, thermal spraying, enveloped casting, brazing and soldering, and a DBC method are well known in the art, and most of the metal-ceramic composite members have recently been manufactured by the DBC method using alumina substrates and a metal active brazing method using aluminum nitride substrates in view of cost problem.

This applicant previously proposed "MANUFACTURE OF METAL-CERAMIC COMPLEX MEMBER, MANUFACTURING APPARATUS AND MOLD FOR MANUFACTURING" in Patent document 1 as a method, apparatus, and mold for directly joining aluminum as a metal plate onto a ceramic member such as a ceramic substrate.

A manufacturing apparatus according to this proposal includes: an atmosphere replacing part where an atmosphere in a mold in which a ceramic member is vertically held is replaced with an atmosphere whose oxygen concentration is controlled at a predetermined value or lower; a preheating part where the mold is preheated; a molten metal pouring part where a molten metal is poured into the mold while the temperature in the mold is maintained at a pouring temperature; a cooling/joining part where the temperature in the mold is lowered to a joining temperature at which the molten metal starts solidifying to join a metal onto a surface of the ceramic member; and a slow cooling part where the mold is cooled slowly. As a result, the use of these manufacturing apparatus and mold makes it possible to make a metal-ceramic joining strength firm, and, moreover, even when metal plates different in thickness are joined onto both faces, metal plates with high precision and uniform thickness can be easily joined if the precision of the mold is controlled to be appropriate.

After the above proposal was made, in accordance with the expansion of the market for metal-ceramic composite members, there has been an increasing demand for the supply of metal-ceramic composite members in various shapes at low cost. In particular, a power amount dealt by the metal-ceramic composite member has been increased, and in accordance with this increase, new demands have arisen for larger and thicker metal plates and more complicated shape thereof for the purpose of dealing with generated heat and for other purposes. There are some cases, however, where the aforesaid proposal cannot always fully respond to such demands.

For example, when a metal-ceramic composite member in which a plurality of ceramic substrates are joined onto a large joining metal is to be produced through the use a mold according to Patent document 1, the ceramic substrate in the mold becomes unsupported due to buoyancy of a poured molten metal, so that stability in shape of the manufactured metal-ceramic composite member cannot be maintained.

Therefore, the inventors of the present invention have made such a proposal in Patent document 2 that a ceramic substrate is placed in a crucible, utilizing its own weight, with a face thereof to be in contact with a molten metal facing upward and the molten metal is poured from above. As a result, it was made possible to manufacture a metal-ceramic composite member in which a plurality of ceramic substrates are joined onto a large joining metal.

(Patent Document 1)

Japanese Patent Laid-open No. Hei 11-226717

(Patent Document 2)

Japanese Patent Laid-open No. 2002-76551

In recent years, a demand for a larger metal as a metal to be joined onto a ceramic substrate has been increasing in accordance with the expansion of the intended use of metal-ceramic composite members, whereas a demand for dimensional precision has been also increasing. In the proposal of Patent document 2, however, a large number of swells occur on a free surface of a large joining metal after the solidification, and in addition, dimension control of the large joining metal is difficult. Consequently, it is necessary to provide a step of polishing the joining metal after a step of joining the joining metal and the ceramic substrate together, which has been explained hitherto, for the purpose of swell removal and dimension control. This has been a factor of lowering productivity and increasing cost. Therefore, an object of the present invention to solve the problem is to provide a mold that is capable of manufacturing, in the aforesaid joining step, a metal-ceramic composite member having a large joining metal free from swell and high in dimensional precision.

Further, the proposal of Patent document 2 adopts such a structure that a ceramic substrate is placed horizontally and a metal is joined only onto one face, and therefore, it is not possible to join the metals on both faces concurrently.

SUMMARY OF THE INVENTION

A first invention to solve the problem stated above is a mold for manufacturing a metal-ceramic composite member by bringing a molten metal into contact with a ceramic member, and it comprises:

a support portion that is provided in the mold and in which the ceramic member is placed with a face of the ceramic member to be in contact with the molten metal facing upward; and a joining portion with a predetermined capacity that is provided between the face of the ceramic member being in contact with the molten metal and an inner wall of the mold and in which the molten metal is poured and filled.

In the mold for manufacturing the metal-ceramic composite member having the above-described structure, the ceramic member is placed in the mold, utilizing its own weight and so on, so that it does not become unsupported in the mold even when the molten metal is poured to an area thereabove. Moreover, the molten metal poured and filled in the joining portion does not have any free surface, so that the dimensional precision of the joining metal that is produced by solidifying the molten metal becomes substantially equal to the dimensional precision of the joining portion. This allows the joining metal to be high in dimensional precision and free from swell on the surface thereof.

A second invention is a mold for manufacturing a metal-ceramic composite member by bringing a molten metal into contact with a ceramic member, and it comprises:

a support portion that is provided in the mold and in which the ceramic member is placed with faces of the ceramic member to be in contact with the molten metal facing upward and downward respectively;

a first joining portion with a predetermined capacity of space that is provided between the face of the ceramic member being in contact with the molten metal and facing upward and an inner wall of the mold and in which the molten metal is poured and filled; and a second joining portion with a predetermined capacity of space that is provided between the face of the ceramic member being in contact with the molten metal and facing downward and the inner wall of the mold and in which the molten metal is poured and filled.

In the mold for manufacturing the metal-ceramic composite member having the above-described structure, the ceramic substrate is placed in the mold, utilizing its own weight and so on, and it is possible to join metals concurrently on both faces of a ceramic by pouring and filling the molten metal in the first and second joining portions. Moreover, the molten metal poured and filled in the joining portions does not have any free surface, so that the dimensional precision thereof becomes substantially equal to the dimensional precision of the joining portion. This can realize high precision and allows the joining metal produced by solidifying the molten metal to be free from swell on the surface thereof.

According to a third invention, in the mold for manufacturing the metal-ceramic composite member according to the first or the second invention, it further comprises a shrinkage cavity inducing portion provided adjacent to the joining portion.

In the mold for manufacturing the metal-ceramic composite member having the above-described structure, by pouring and filling a predetermined amount of the molten metal also in the shrinkage cavity inducing portion when the molten metal is poured and filled, it is possible to cause shrinkage cavity of the metal to be generated in this portion when the molten metal is solidified, which makes it possible to avoid the generation of the shrinkage cavity in a product.

A fourth invention is a method for manufacturing a metal-ceramic composite member, and it comprises: pouring a predetermined amount of the molten metal into the mold according to the third invention; thereafter, cooling the molten metal from under the mold to solidify the molten metal; and inducing shrinkage cavity to be generated in the shrinkage cavity inducing portion.

When, adopting the above-described structure, the solidification of the molten metal in the mold is controlled to progress from a lower portion to an upper portion and the shrinkage cavity is induced to be generated in the shrinkage cavity inducing portion, it is possible to avoid the generation of the shrinkage cavity in the product.

A fifth invention is a method for manufacturing a metal-ceramic composite member by bringing a molten metal into contact with a ceramic member, using a mold comprising:

a support portion that is provided in the mold and in which the ceramic member is placed with faces of the ceramic member to be in contact with the molten metal facing upward and downward respectively;

a first joining portion with a predetermined capacity of space that is provided between the face of the ceramic member being in contact with the molten metal and facing upward and an inner wall of the mold and in which the molten metal is poured and filled; and a second joining portion with a predetermined capacity of space that is provided between the face of the ceramic member being in contact with the molten metal and facing downward and the inner wall of the mold and in which the molten metal is poured and filled, wherein the molten metal is poured and filled first in the first joining portion when the molten metal is poured and filled in the first and the second joining portion.

When the molten metal is poured and filled in the joining portions provided above and below the ceramic member, the molten metal is poured and filled first in the upper first joining portion to press the ceramic member by its weight, and thereafter, the molten metal is poured and filled in the lower second joining portion. Consequently, the molten metal can be poured and filled while the ceramic member is kept stably placed in the mold.

DETAILED DESCRIPTION OF THE PREFERRED EMBODIMENTS

Figure 1A:
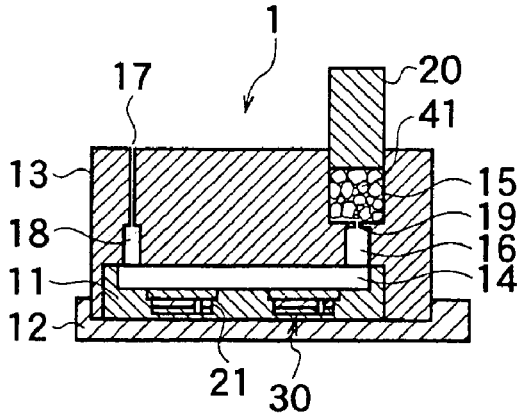
FIG. 1A to FIG. 1D are cross sectional views showing steps of manufacturing a metal-ceramic composite member through the use of a mold according to this embodiment.

Hereinafter, examples of this embodiment of the present invention will be explained using FIG. 1A to FIG. 5.

FIG. 1A to FIG. 1D are cross sectional views showing steps of manufacturing a metal-ceramic composite member through the use of a mold 1 for manufacturing metal-ceramic composite members (hereinafter, referred to as a mold 1) according to this embodiment, each of the drawings showing the state in each step. FIG. 2 is a cross sectional view showing an example of the metal-ceramic composite member manufactured in the steps in FIG. 1A to FIG. 1D, and FIG. 3A to FIG. 3D are cross sectional views showing steps of manufacturing a metal-ceramic bonded substrate used in the steps in FIG. 1A to FIG. 1D. Further, FIG. 4A to FIG. 4E are cross sectional views showing steps of manufacturing a metal-ceramic composite member through the use of a mold 2 for manufacturing metal-ceramic composite members (hereinafter referred to as a mold 2) according to a different form of this embodiment, each of the drawings showing the state in each step. FIG. 5 is a cross sectional view showing an example of the metal-ceramic composite member manufactured in the steps in FIG. 4A to FIG. 4E.

First, the mold 1 will be explained, using FIG. 1A.

The mold 1 has a mold main body 11, an upper container 13 covering the mold main body 11 from above, and a lower container 12 supporting the mold main body 11 and the upper container 13 from under. Carbon is suitably used as materials of these three constituents.

On an upper face of the mold main body 11, a first joining portion 14 being a first recessed portion in which molten metal is to be poured and filled is provided, and in a bottom portion of the first joining portion 14, metal-ceramic bonded substrate support portions 21 being second recessed portions are provided as supporting portions in which metal-ceramic bonded substrates 30 being an example of ceramic members (ceramic members, which will be detailed later using FIG. 3A to FIG. 3D, each being so structured that a metal plate 33 joined via a brazing filler 32 is provided on a ceramic substrate 31) are to be placed.

Note that FIG. 1A to FIG. 1D show the states in which the metal-ceramic bonded substrates 30 are placed in the metal-ceramic bonded substrate support portions 21.

On an upper face of the upper container 13, a metal material holding portion 15 is provided in which a metal material 41 to be a material of a molten metal is filled, and a piston 20 is provided on the filled metal material 41. A lower portion of the metal material holding portion 15 communicates with a shrinkage cavity inducing portion 16 on a metal material holding portion side via a narrow portion 19, and further communicates with the aforesaid first joining portion 14. An air vent 17 is provided on an opposite side of the metal material holding portion 15 on the upper face of the upper container 13, and this air vent 17 communicates with the aforesaid first joining portion 14 via a shrinkage cavity inducing portion 18 on an air vent side.

The lower container 12 supports the aforesaid mold main body 11 and upper container 13 from under, being engaged therewith, and they are integrated together to constitute the mold 1. At this time, a space with a predetermined capacity is formed in the mold main body 11 by the first joining portion 14, upper faces of the metal-ceramic bonded substrates 30, and an inner wall of the upper container 13.

Next, an example of steps of manufacturing a metal-ceramic composite member through the use of the mold 1 will be explained, using FIG. 1A to FIG. 1D. Note that a joining furnace and so on described in Patent document 1 can be suitably used in this manufacture when respective steps of replacing an atmosphere in the mold, preheating the mold, pouring and filling the molten metal in the joining portion, and cooling the mold are implemented.

Figure 2:
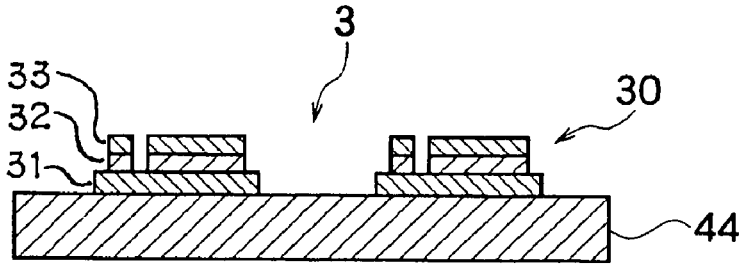
FIG. 2 is a cross sectional view showing an example of the metal-ceramic composite member manufactured in the steps in FIG. 1A to FIG. 1D.

First, as shown in FIG. 1A, the mold main body 11 is installed on the lower container 12, and the metal-ceramic bonded substrates 30 are placed in the metal-ceramic bonded substrate support portions 21 provided on the mold main body 11. At this time, the metal-ceramic bonded substrates 30 are received in the metal-ceramic bonded substrate support portions 21 being the second recessed portions, without wobbling, and the ceramic substrates 31 thereof are placed to face upward and become flush with a bottom portion of the joining portion 14 being the first recessed portion. When the metal-ceramic bonded substrates 30 have been placed in the mold main body 11, the mold main body 11 is covered with the upper container 13 and is engaged with the lower container 12, so that these three constituents are integrated to constitute the mold 1. When the integrated formation of the mold 1 is completed, a necessary and sufficient amount of the metal material 41 is filled in the metal material holding portion 15 of the upper container 13. As this metal material 14, aluminum or an aluminum alloy is suitably used, and as a form of the material, a shot form or a grain form larger in diameter than the narrow portion 19 is preferable in view of operability.

Figure 1B:
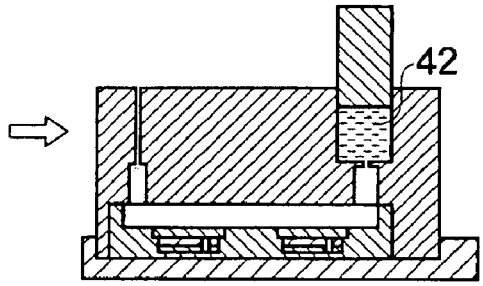
Figure 1C:
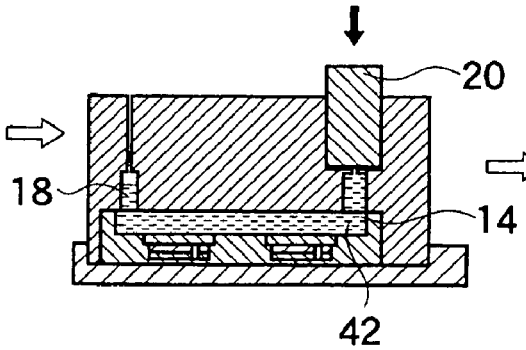

Next, an atmosphere inside and outside the mold 1 is replaced with an inert gas such as a nitrogen gas from the atmosphere. When the gas replacement of the atmosphere is completed, the mold 1 is preheated to a predetermined temperature, so that the metal material 41 is melted to turn into the molten metal 42 as shown in FIG. 1B. Next, as shown in FIG. 1C, the piston 20 is pressed so as to pour and fill a predetermined amount of the molten metal 42 in an area from the first joining portion 14 to the shrinkage cavity inducing portion 18 on the air vent side.

At this time, a metal oxide coating is sometimes produced on a surface of the molten metal 42, and it is preferable that the molten metal 42 supplied to the ceramic substrates 31 of the metal-ceramic bonded substrates 30 has a fresh surface since a metal-ceramic joining strength can be thereby increased. Then, when the molten metal 42 in the metal material holding portion 15 passes through the narrow portion 19, this metal coating is broken, so that the molten metal 42 having a fresh surface is supplied to the first joining portion 14. Further, such a structure is preferable here that the molten metal 42 supplied to the first joining portion 14 is once dropped onto the mold main body 11 in the first joining portion 14, instead of being directly dropped onto the ceramic substrates 31, and is made to flow in the joining portion 14 therefrom so as to be in contact with the ceramic substrates 31. The adoption of this structure causes the metal oxide coating, even if there exists any, that cannot be broken in the narrow portion 19 to be taken into an inner part of the molten metal 42 from the surface thereof while the molten metal 42 is flowing, so that the fresher molten metal 42 is supplied to the ceramic substrates 31.

Incidentally, when the joining furnace in use has an apparatus or a structure for pouring a molten metal, such a structure may also be adopted that the molten metal 42 is poured thereto at an instant when the preheating of the mold 1 is finished, instead of filling the metal material 41 in the metal material holding portion 15 in the mold 1 in advance.

When the molten-metal pouring and filling are finished, the mold 1 is cooled from under. At this time, it is preferable that the cooling progresses in one direction from a lower portion toward an upper portion of the mold 1. When the cooling of the mold 1 progresses in one direction from the lower portion toward the upper portion, the solidification of the molten metal 42 in the mold 1 progresses from a lower portion to an upper portion, so that the shrinkage cavity inducing portions 16, 18 become portions where the molten metal 42 is finally solidified. This makes it possible to induce the generation of the shrinkage cavity into the shrinkage cavity inducing portions 16, 18.

Figure 1D:
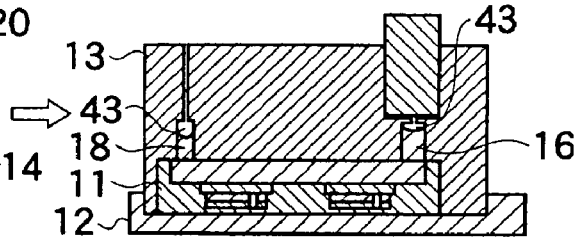

The state in which the solidification of the molten metal 42 is finished after the cooling of the mold 1 progresses is shown in FIG. 1D. As the molten meal 42 is cooled and solidified, the volume thereof reduces to generate a shrinkage cavity 43, but this shrinkage cavity 43 is induced to portions where the molten metal 42 is finally cooled and solidified, namely, the shrinkage cavity inducing portion 16 on the metal material holding portion side and the shrinkage cavity inducing portions 18 on the air vent side. When the mold 1 has been cooled, the mold main body 11, the lower container 12, and the upper container 13 are separated, and the induced shrinkage cavity portions are removed. In this manner, a metal-ceramic composite member according to this embodiment has been obtained.

Here, the obtained metal-ceramic composite member according to this embodiment will be explained, using FIG. 2.

A metal-ceramic composite member 3 according to this embodiment is so structured that a predetermined number of the metal-ceramic bonded substrates 30 are joined onto a large joining metal 44. Note that, in an example of this embodiment, the metal-ceramic bonded substrate 30 is so structured that the metal plate 30 is joined onto the ceramic substrate 31 via the brazing filler 32, as described above.

Here, the large joining metal 44 can take shapes such as a flat plate and a comb-shaped fin as required by working the aforesaid upper container 13. Further, since the large joining metal 44 is produced in such a manner that the molten metal 42 is cooled and solidified in the first joining portion 14 in the state in which it does not have any free surface, the dimensional precision thereof is substantially equal to the dimensional precision of the first joining portion 14, and no swell has been observed on the surface thereof. Moreover, as a result of the induction of the shrinkage cavity to the aforesaid shrinkage cavity inducing portions, no shrinkage cavity has been observed on the large joining metal 44, only by a simple post process of removing the induced shrinkage cavity portions.

Here, the manufacture of the metal-ceramic bonded substrate used in this embodiment will be briefly explained, using FIG. 3A to FIG. 3D.

Figures 3A, 3B, 3C, 3D:
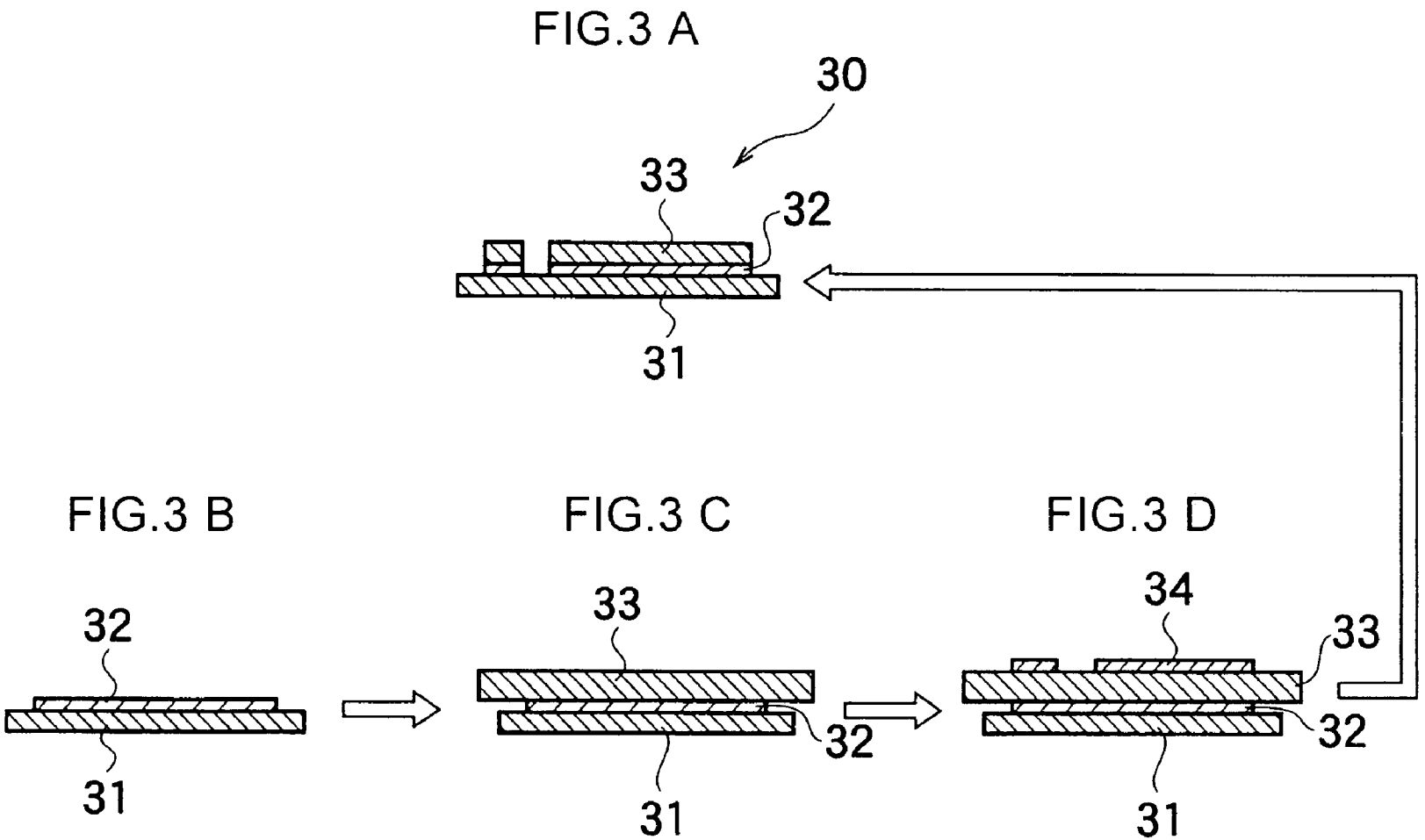
FIG. 3A to FIG. 3D are cross sectional views showing steps of manufacturing a metal-ceramic bonded substrate.

First, as shown in FIG. 3A, the metal-ceramic bonded substrate 30 is so structured that the metal plate 33 is joined onto the ceramic substrate 31 using the brazing filler 32.

The steps of manufacturing this metal-ceramic bonded substrate 30 will be explained with reference to FIG. 3B to FIG. 3D.

First, as shown in FIG. 3B, the brazing filler 32 in a paste form containing active metal such as Ti and Zr is printed on the ceramic substrate 31. The printing thickness, though it may be determined appropriately depending on the materials of the ceramic substrate 31, the metal plate 33, and the brazing filler 32, is preferably about 20 $\mu$m when, for example, aluminum nitride is used as the ceramic substrate 31 and copper is used as the metal plate 33.

Then, as shown in FIG. 3C, the metal plate 33 is put on the brazing filler 32, and they are heated to about 850° C. in a vacuum atmosphere, so that the metal plate 33 is joined onto the ceramic substrate 31. As the metal plate 33, copper is preferably used. As the ceramic substrate 31, a substrate of aluminum nitride, alumina, or the like is preferably used.

Further, as shown in FIG. 3D, an etching resist 34 is printed in a predetermined pattern on this metal plate 33 joined onto the ceramic substrate 31, and thereafter, etching is applied to remove the metal plate 33 and the brazing filler 32 outside the pattern.

Thus, obtained is the metal-ceramic bonded substrate 30, which is shown in FIG. 3A, having on the ceramic substrate 31 the metal plate 33 and the brazing filler 32 that have been etched into the pattern.

Next, a mold 2 will be explained using FIG. 4A.

The mold 2 has, similarly to the aforesaid mold 1, a mold main body 11, an upper container 13 covering the mold main body 11 from above, and a lower container 12 that supports the mold main body 11 and the upper container 13 from under. Carbon is suitably used as materials of these three constituents.

On an upper face of the mold main body 11, a first joining portion 14 being a first recessed portion in which molten metal is to be poured and filled is provided, ceramic member support portions 25 being second recessed portions are provided, as support portions in which a predetermined number of ceramics members are to be placed, in a bottom portion of this first joining portion 14, second joining portions 22 as third recessed portions in which the molten metal is to be poured and filled are provided in lower portions of the respective ceramic member support portions 25, and a molten metal runner 23 is provided to extend from one side in the first joining portion 14 toward the second joining portions 22. This molten metal runner 23 connects the second joining portions 22 and thereafter, communicates with a mold main body air vent 24.

This mold main body air vent 24, which is larger in diameter than the molten metal runner 23, is open to the upper face of the mold main body 11 to communicate with a shrinkage cavity inducing portion 18 on the air vent side which will be described later.

As for the upper container 13, which has substantially the same structure as that of the upper container 13 of the aforesaid mold 1, it has a metal material holding portion 15 in which a metal material 41 to be a material of the molten metal is filled, and a piston 20 is provided on the filled metal material 41. A lower portion of the metal material holding portion 15 communicates with a shrinkage cavity inducing portion 16 on a metal material holding portion side via a narrow portion 19, and further communicates with the aforesaid first joining portion 14. An air vent 17 is provided on an upper face of the upper container 13 on an opposite side of the metal material holding portion 15, and this air vent 17 communicates with the aforesaid mold main body air vent 24 via the shrinkage cavity inducing portion 18 on the air vent side.

Note that FIG. 4A to FIG. 4E show the states in which the ceramic substrates 31 are placed in the ceramic member support portions 25.

The lower container 12, which also has substantially the same structure as that of the lower container 12 of the aforesaid mold 1, supports the aforesaid mold main body 11 and upper container 13 from under, being engaged therewith, and they are integrated to constitute the mold 2. At this time, in the mold main body 11, a first space with a predetermined capacity is formed by the first joining portion 14, upper faces of the metal-ceramic bonded substrates 30, and an inner wall of the upper container 13, and a second space with a predetermined capacity is formed by the second joining portions 22 and lower faces of the metal-ceramic bonded substrates 30.

Next, an example of steps of manufacturing the metal-ceramic composite member through the use of the mold 2 will be explained, using FIG. 4A to FIG. 4E. Note that, also in this manufacture, the joining furnace and so on described in Patent document 1 can be suitably used in implementing the respective steps of replacing the atmosphere in the mold, preheating the mold, pouring and filling the molten metal to the joining portions, and cooling the mold.

Figure 4A:
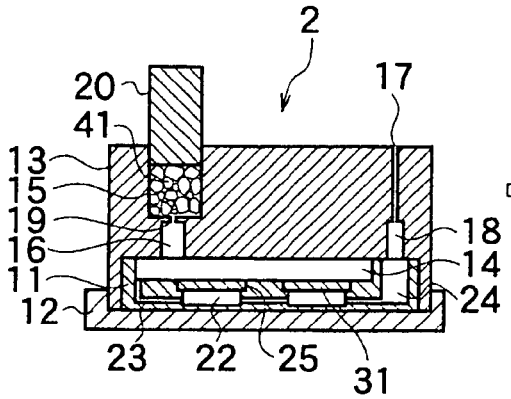
FIG. 4A to FIG. 4E are cross sectional views showing steps of manufacturing a metal-ceramic composite member through the use of a mold according to a different form of this embodiment.
Figure 5:
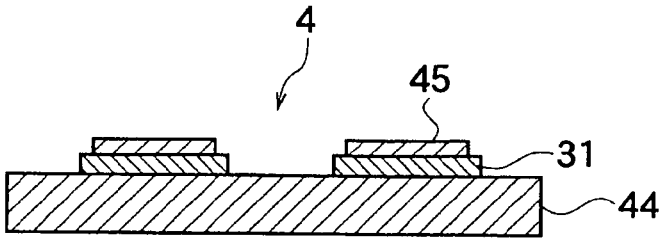
FIG. 5 is a cross sectional view showing an example of the metal-ceramic composite member manufactured in the steps in FIG. 4A to FIG. 4E.

First, as shown in FIG. 4A, the mold main body 11 is installed on the lower container 12, and the ceramic substrates 31 as ceramic members are placed in the ceramic member support portions 25 provided on this mold main body 11. At this time, each of the ceramic substrates 31 is placed with a first face and a second face thereof facing upward and downward respectively. When the ceramic substrates 31 have been placed in the mold main body 11, the mold main body 11 is covered with the upper container 13, similarly to the aforesaid mold 1, and they are engaged with the lower container 12 to be integrated so as to constitute the mold 2. When the integrated formation of the mold 2 is completed, a necessary and sufficient amount of the metal material 41 is filled in the metal material holding portion 15 of the upper container 13.

Figure 4B:
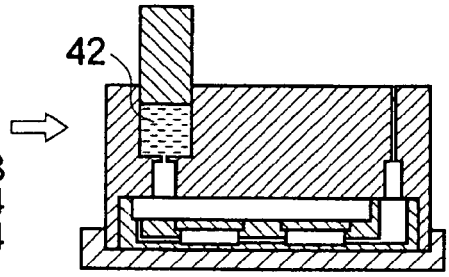

Next, similarly to the aforesaid mold 1, an atmosphere inside and outside the mold 2 is replaced with an inert gas such as a nitrogen gas from the atmosphere, and when the gas replacement of the atmosphere is completed, the mold 2 is preheated to a predetermined temperature, so that the metal material 41 is melted to turn into a molten metal 42, as shown in FIG. 4B.

Figure 4C:
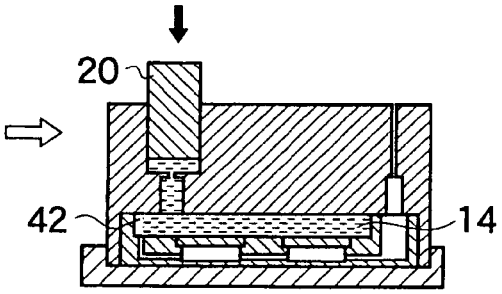

When the metal material 41 is melted to turn into the molten metal 42, the piston 20 is pressed, as shown in FIG. 4C, so that the molten metal 42 is poured and filled first in the first joining portion 14.

At this time, as in the explanation on the mold 1, it is preferable that the molten metal 42 supplied to the ceramic substrates 31 has a fresh surface since a metal-ceramic joining strength can be thereby increased. Therefore, it is preferable to adopt such a structure that the molten metal 42 in the metal material holding portion 15 is passed through the narrow portion 19, is supplied thereafter to the first joining portion 14, and is made to flow therefrom to be in contact with the ceramic substrates 31. Further, the aforesaid molten metal runner 23 is open in the bottom portion of the first joining portion 14 in the mold 2, but when the molten metal 42 is supplied to an area right above this opening portion, the pouring and filling of the molten metal 42 in the second joining portions 22 may possibly start before it is sufficiently poured and filled in the first joining portion 14. In view of the above, when the molten metal 42 is filled in the first joining portion 14, it is preferable to prevent the molten metal 42 from being supplied to the ceramic substrates 31 and the opening of the molten metal runner 23 when it is poured and filled to the first joining portion 14.

Figure 4D:
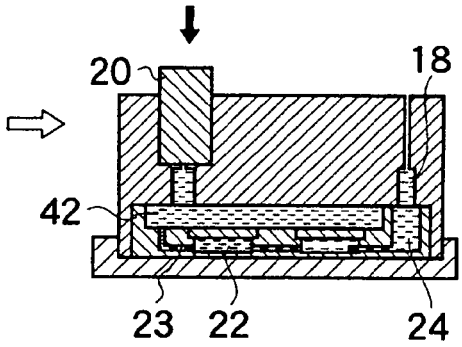

Here, when the piston 20 is further pressed, the molten metal 42 is poured and filled in the second joining portions 22 via the molten metal runner 23, as shown in FIG. 4D, and a predetermined amount thereof further reaches the shrinkage cavity inducing portion 18 on the air vent side via the mold main body air vent 24. When this molten metal 42 is poured and filled in the second joining portions 22, the ceramic substrates 31 are pressed toward the ceramic member support portions 25 due to the weight of the molten metal 42 poured and filled in the first joining portion 14, which makes it possible to pour and fill the molten metal 42 while the ceramic substrates 31 are kept mechanically stable.

Incidentally, similarly to the aforesaid mold 1, when the joining furnace in use has an apparatus or a structure for pouring molten metal, such a structure may also be adopted in the mold 2 that the molten metal 42 is poured thereto at an instant when the preheating of the mold 2 is finished, instead of filling the metal material 41 in the metal material holding portion 15 in advance.

When the molten-metal pouring and filling are finished, the mold 2 is cooled from under. At this time, when the mold 2 is cooled in such a manner that the cooling progresses in one direction from a lower portion toward an upper portion of the mold 2, the shrinkage cavity inducing portions 16, 18 become portions where the molten metal 42 is finally solidified.

Figure 4E:
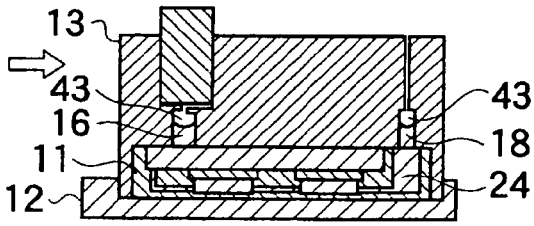

The state in which the solidification of the molten metal 42 is finished after the cooling of the mold 2 progresses is shown in FIG. 4E. As the molten meal 42 is cooled and solidified, the volume thereof reduces to generate a shrinkage cavity 43, but this shrinkage cavity 43 is induced to portions where the molten metal 42 is finally cooled and solidified, namely, the shrinkage cavity inducing portion 16 on the metal material holding portion side and the shrinkage cavity inducing portion 18 on the air vent side. Particularly, as for the volume reduction in accordance with the cooling and solidification of the molten metal 42 in the second joining portion 22, the molten metal 42 in the mold main body air vent 24 also compensates this. When the cooling of the mold 2 is finished, the mold main body 11, the lower container 12, and the upper container 13 are separated, and the induced shrinkage cavity portions are removed. In this manner, a metal-ceramic composite member according to a different form of this embodiment has been obtained.

Here, the obtained metal-ceramic composite member according to the different form of this embodiment will be explained, using FIG. 5.

A metal-ceramic composite member 4 according to the different form of this embodiment is so structured that a predetermined number of ceramic substrates 31 are joined onto a large joining metal 44, each of the ceramic substrates 31 having a thin joining metal 45 joined thereon. Here, the large joining metal 44, similarly to the use of the aforesaid mold 1, can take shapes such as a flat plate and a comb-shaped fin as required by working the upper container 13. The thin joining metals 45 can be turned into predetermined wiring materials, for example, when they are etched to predetermined patterns. Since the large joining metal 44 and the thin joining metals 45 are both produced by the aforesaid cooling and solidification in the state in which they do not have any free surface in the first and second joining potions, the dimensional precision thereof is substantially equal to the dimensional precision in the first joining portion 14 and the second joining portions 22, and no swell has been observed on the surfaces thereof. Moreover, as a result of the induction of the shrinkage cavity to the aforesaid shrinkage cavity inducing portions, no shrinkage cavity has been observed on the large joining metal 44 and the thin joining metals 45, only by a simple post process of removing the induced shrinkage cavity portions.

As is detailed above, a mold according to the present invention has a support portion in which a ceramic member is to be placed, with a face of the ceramic member to be in contact with a molten metal facing upward, and a joining portion with a predetermined capacity that is provided between the face of the ceramic member being in contact with the molten metal and an inner wall of the mold and in which the molten metal is to be poured and filled. Consequently, the ceramic member placed in the mold utilizing its own weight does not become unsupported in the mold even when the molten metal is poured in an area thereabove, and since the molten metal poured and filled in the joining portion does not have any free surface, the dimensional precision of the joining metal produced by solidifying the molten metal is substantially equal to the dimensional precision of the joining portion, so that the joining metal can be high in precision and free from swell occurring on the surface thereof.

What is claimed is:

1. A mold for manufacturing a metal-ceramic composite member by bringing a molten metal into contact with a ceramic member, comprising:

a support portion that is provided in said mold and in which the ceramic member is placed with a face of the ceramic member to be in contact with the molten metal facing upward and downward respectively;

a first joining portion with a predetermined capacity of space that is provided between the face of the ceramic member being in contact with molten metal and facing upward and an inner wall of said mold and in which the molten metal is poured and filled; and a second joining portion with a predetermined capacity of space that is provided between the face of the ceramic member being in contact with the molten metal and facing downward and the inner wall of said mold and in which the molten metal is poured and filled, wherein a molten metal runner provided in an upper part of said first joining portion is connected to said first joining portion, and in said first joining portion, the molten metal runner is provided from one side toward the second joining portion, so as to avoid an outlet of the molten metal runner.

2. A mold for manufacturing a metal-ceramic composite member according to claim 1, wherein the metal molten runner provided in the upper part of said first joining portion is connected to said first joining portion through a narrow portion.

3. A mold for manufacturing a metal-ceramic composite member according to claim 2, further comprising a shrinkage cavity inducing portion provided adjacent to said first joining portion.

4. A mold for manufacturing a metal-ceramic composite member according to claim 1, wherein the ceramic member is a ceramic substrate.

5. A method for manufacturing a metal-ceramic composite member by bringing a molten metal into contact with a ceramic member, wherein the molten metal is poured and filled first in the first joining portion and next is poured and filled in the second joining portion when the molten metal is poured and filled in the first and second joining portions by using the mold according to claim 1.

6. A method for manufacturing a metal-ceramic composite member by bringing a molten metal into contact with a ceramic member, wherein the molten metal is passed through the narrow portion first, and thereafter is poured and filled in the first joining portion, and next is poured and filled in the second joining portion, when the molten metal is poured and filled in the first and the second joining portions by using the mold according to claim 2.

7. A method for manufacturing a metal-ceramic composite member by bringing a molten metal into contact with a ceramic member, wherein the molten metal is poured and filled in the first joining portion first, or is passed through the narrow portion and thereafter is poured and filled in the first joining portion, and next is poured and filled in the second joining portion, when the molten metal is poured and filled in the first and second joining portions by using the mold according to claim 3, and after a predetermined amount of molten metal is poured in the mold, the molten metal is cooled and solidified from a lower part of the mold, whereby a shrinkage cavity is generated in the shrinkage cavity inducing portion.

8. A mold for manufacturing a metal-ceramic composite member according to claim 2, wherein the ceramic member is ceramic substrate.

9. A mold for manufacturing a metal-ceramic composite member according to claim 3, wherein the ceramic member is ceramic substrate.

10. A method of manufacturing a metal-ceramic composite member according to claim 5, wherein the ceramic member is a ceramic substrate.

11. A method of manufacturing a metal-ceramic composite member according to claim 6, wherein the ceramic member is a ceramic substrate.

12. A method of manufacturing a metal-ceramic composite member according to claim 7, wherein the ceramic member is a ceramic substrate.

* * * * *

UNITED STATES PATENT AND TRADEMARK OFFICE

CERTIFICATE OF CORRECTION

PATENT NO. : 6,997,233 B2 
DATED : February 14, 2006
INVENTOR(S) : Hideyo Osanai, Susumu Ibaragi and Makoto Namioka It is certified that error appears in the above-identified patent and that said Letters Patent is hereby corrected as shown below:

Column 12,
Line 7, change second "the" to -- a --.

Signed and Sealed this

Twenty-fifth Day of April, 2006

JON W. DUDAS
*Director of the United States Patent and Trademark Office*